United States Patent [19]

Aoki

[11] 4,271,567

[45] Jun. 9, 1981

[54] AUTOMATIC LOCK SLIDER FOR SLIDE FASTENER

[75] Inventor: Tsunetaka Aoki, Kamiichi, Japan

[73] Assignee: Yoshida Kogyo K.K., Tokyo, Japan

[21] Appl. No.: 17,944

[22] Filed: Mar. 6, 1979

[30] Foreign Application Priority Data

Mar. 30, 1978 [JP] Japan ..... 53-41529[U]

[51] Int. Cl.[3] ..... A44B 19/30

[52] U.S. Cl. ..... 24/205.14 R

[58] Field of Search ..... 24/205.14 R, 205.14 K

[56] References Cited

U.S. PATENT DOCUMENTS

| | | | |
|---|---|---|---|
| 2,373,523 | 4/1945 | Winterhalter | 24/205.14 R |
| 3,320,645 | 5/1967 | Burbank | 24/205.14 R |
| 3,813,736 | 6/1974 | Fukuroi | 24/205.14 R |
| 3,945,090 | 3/1976 | Fukuroi | 24/205.14 R |
| 4,102,022 | 7/1978 | Aoki | 24/205.14 R |
| 4,139,928 | 2/1979 | Aoki | 24/205.14 R |

FOREIGN PATENT DOCUMENTS

| | | | |
|---|---|---|---|
| 70799 | 8/1946 | Norway | 24/205.14 R |

*Primary Examiner*—Roy D. Frazier
*Assistant Examiner*—Peter A. Aschenbrenner
*Attorney, Agent, or Firm*—Robert E. Burns; Emmanuel J. Lobato; Bruce L. Adams

[57] ABSTRACT

An automatically locking slider includes a locking spring for locking the slider in position on a slide fastener. The locking spring has at one end a locking prong movable into and out of a slide fastener guide channel and at the other end a first retaining portion resting on a slider body. The locking spring is further provided with a resilient tongue or tongues constituting a second retaining portion which is supported by a pivot means in a plane above and remote from the general plane of an upper body wing so as to permit the locking prong to move angularly about the pivot means.

6 Claims, 10 Drawing Figures

AUTOMATIC LOCK SLIDER FOR SLIDE FASTENER

BACKGROUND OF THE INVENTION

1. Field of the Invention

This invention relates to an automatically locking slider for slide fasteners.

2. Description of Prior Art

Japanese Utility Model Publication No. 46-35376 published Dec. 6, 1971 discloses a self-locking slider for slide fasteners. The slider essentially includes a slider body constituted by upper and lower wings, a yoke attached to the upper wing, a locking spring supported on the upper wing so as to normally project into a slide fastener guide channel by its locking prong, and a pull tab operatively connected to the locking spring for retracting the locking prong away from the guide channel. The locking spring has a pivotal portion received in a recess in the outer surface of the upper wing and a resilient tongue simply touching on a ceiling of the yoke, so that the locking prong is angularly movable about the pivotal portion in response to pivotal movement of the pull tab. Thus, the axis of pivotal movement of the locking prong is disposed near the guide channel where the locking prong engages in the space between adjacent fastener elements of the slide fastener. With this arrangement, the locking prong tends to accidentally shift out of engagement with the fastener elements due to the elements being tilted under the influence of a pull that is exerted in opposite directions transversely of the slide fastener.

SUMMARY OF THE INVENTION

It is therefore an object of this invention to provide an automatically locking slider for slide fasteners in which the axis of pivotal movement of a locking spring is disposed in a plane above and remote from the general plane of an upper body wing, thereby preventing a locking prong of the locking spring from accidentally disengaging from the fastener elements of a slide fastener.

Another object of the invention is to provide an automatically locking slider for slide fasteners which is protected against transverse displacement of a locking spring.

According to this invention, an automatically locking slider for slide fasteners includes a locking spring for locking the slider in position on the rows of interlocking fastener elements. The locking spring has at one end a locking prong movable into and out of a slide fastener guide channel and at the other end a first retaining portion resting on a slider body. The locking spring is further provided with a resilient tongue or tongues constituting a second retaining portion which is supported by a pivot means in a plane above and remote from the general plane of an upper body wing so as to permit the locking prong to move angularly about the pivot means.

A fuller understanding of the invention will be had by referring to the following description taken in conjunction with the accompanying drawings, in which like reference numerals designate like parts throughout several views.

DETAILED DESCRIPTION OF THE PREFERRED EMBODIMENTS

Figure 1:
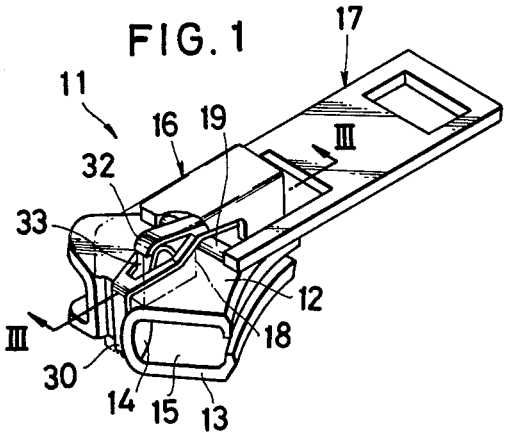
FIG. 1 is a perspective view, with parts broken away, of an automatically locking slider for slide fasteners embodying this invention.
Figure 2:
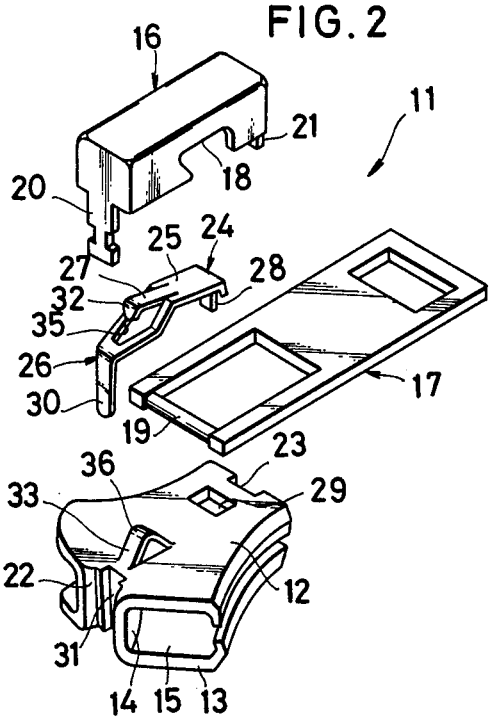
FIG. 2 is an exploded perspective view of the slider of FIG. 1.

FIGS. 1 and 2 show an automatically locking slider 11 for slide fasteners which includes a body constituted by upper and lower wings 12,13. The upper and lower wings 12,13 are joined at their front ends by a neck 14 and spaced apart in confronting relation to define therebetween a generally Y-shaped guide channel 15 for the passage of interlocking fastener element rows of a slide fastener.

Attached to the upper wing 12 is a yoke 16 to which a pull tab 17 is pivotally connected and manipulated to effect reciprocal movement of the slider 11 along the interlocking fastener element rows for closing and opening the slide fastener. The yoke 16 is generally of a rectangular box-shape having a transverse opening 18 through which a pivotal end or trunnion 19 of the pull tab 17 extends. The yoke 16 is provided at opposite ends with a pair of opposed front and rear legs 20,21 depending therefrom. The front leg 20 of the yoke is engaged in a vertical and major-width groove 22 formed in the slider body neck 14, and the rear leg 21 is inwardly bent and fitted in an L-shaped recess 23 formed in the upper wing 12 at its rear end. Thus, the yoke 16 is firmly held in place on the upper wing 12.

A locking spring 24 is supported on the upper wing 12 for locking the slider 11 in position on a slide fastener, and is concealed by the yoke 16. The locking spring 24, which is usually made of a metallic material, includes a main portion 25 and first and second retaining portions 26,27. The main portion 25 of the locking spring 24 extends over and across the trunnion 19 of the pull tab 17, slanting down toward and terminating in a downwardly bent locking prong 28. With the locking spring 24 held in its operating disposition (FIG. 3) as discussed in the following paragraph, the locking prong 28 extends through an aperture 29 in the upper wing to project into the guide channel 15 for engaging between two successive fastener elements of one of opposed fastener stringers threaded through the channel 15. The aperture 29 is located adjacent the rear end of the upper body wing 12.

The first retaining portion 26 of the locking spring 24 extends from an upper end of the main portion 25, slanting down toward the upper wing 12, then extends parallelly of the latter, and terminates in a downwardly bent end 30. The downwardly bent end 30 is received in a minor-width groove 31 which is formed in and along the bottom surface of the major-width groove 22 in the neck 14, touching on the bottom surface of the minor-width groove 31. The second retaining portion 27 of the locking spring 24 is a resilient tongue cut out from the material of the spring 24, the resilient tongue being just an extension of the main portion 25 and terminating in a curved end 32. The curved end 32 is supported on its concave side by a rounded top 36 of a projection 33 formed on the upper wing 12 and on its convex side by a ceiling 34 of the yoke 16. The projection 33 is located adjacent the slider body neck 14, and extends through an opening 35 in the locking spring 24 toward and terminating short of the yoke ceiling 34. The opening 35 is a byproduct of provision of the resilient tongue formed by the second retaining portion 27. Thus, the locking spring 24 is automatically held in its operating position (FIG. 3) in which the locking prong 28 projects into the guide channel 15 to engage between two successive fastener elements of one of the fastener stringers threaded through the channel 15, in order to lock the slider 11 to the stringers to prevent undesired movement of the slider in the direction of opening the slide fastener.

Figure 3:
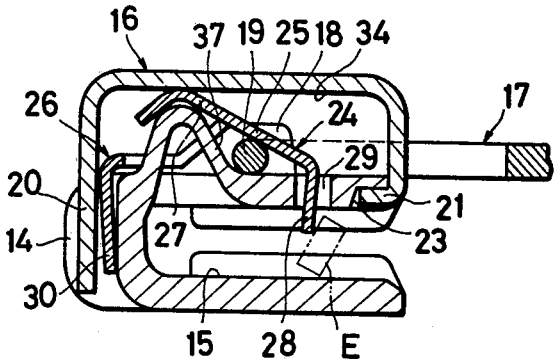
FIG. 3 is an enlarged cross-sectional view taken along the line III—III of FIG. 1, showing the slider in locked position.
Figure 4:
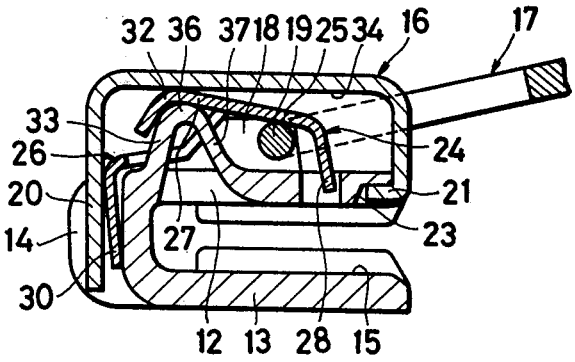
FIG. 4 is a view similar to FIG. 3, but showing the slider in unlocked position.

In operation, when a pull is exerted on the pull tab 17 for moving the slider 11 in the direction of opening the slide fastener, i.e., toward the right as viewed in FIG. 3, the trunnion 19 of the pull tab 17 moves upwardly toward the yoke ceiling 34 against the bias of the locking spring 24. This causes the locking prong 28 of the spring 24 to turn about the rounded top 36 of the projection 33 away from the guide channel 15, as shown in FIG. 4, to disengage from two successive fastener elements of the slide fastener. Accordingly, the slider 11 is released and can now be moved in the direction of opening the slide fastener. When the pull exerted on the pull tab 17 ceases, the locking spring 24 returns to its normal position of FIG. 3 under its own resilience and the locking prong 28 reengages the fastener stringers.

In order to now move the slider 11 in the direction of closing the slider fastener, i.e., toward the left as viewed in FIG. 3, the pull tab 17 is pulled leftwardly. The trunnion 19 engaged beneath the locking spring 24 slides upwardly along an inclined surface 37 of the projection 33 and acts again on the locking spring 24 to lift the locking prong 28 out of the guide channel 15.

Assuming that a pull is exerted in opposite directions transversely of the slide fastener while the slider 11 is held in its locked disposition, the slider 11 will be slightly moved in the direction of opening the slide fastener, i.e., toward the right as viewed in FIG. 3, causing one of two successive fastener elements E engaged by the locking prong 28 to tilt as indicated by a dash-and-two-dot line in FIG. 3. However, since the upward path of travel of the locking prong 28 is still obstructed by that tilted fastener element E, the locking prong 28 is prevented from shifting out of engagement therewith.

Figure 5:
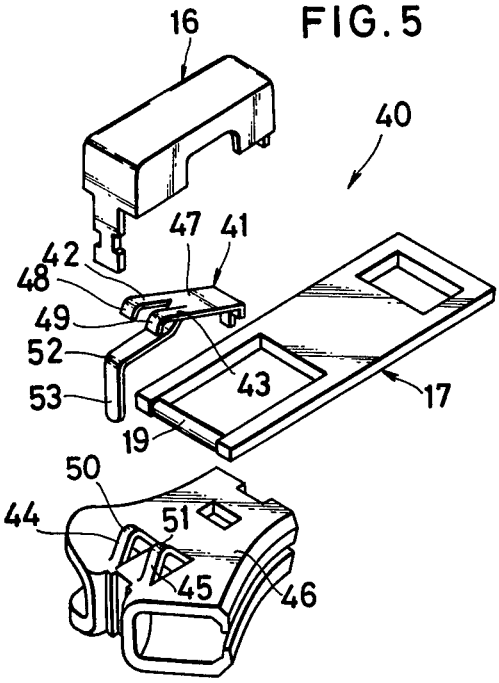
FIG. 5 is an exploded perspective view of a modified form of slider according to the invention.
Figure 6:
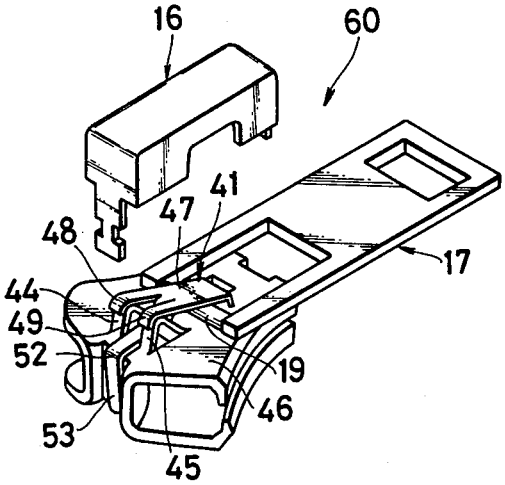
FIG. 6 is a perspective view of the slider of FIG. 5, with all parts except a yoke assembled together.

FIGS. 5 and 6 show a modified slider 40, in which the only difference from the preceding embodiment is that a modified locking spring 41 has a pair of laterally spaced resilient tongues 42,43 constituting its second retaining portion. The resilient tongues 42,43 are supported respectively by a pair of laterally spaced projections 44,45 formed on an upper slider body wing 46. A main portion 47 of the locking spring 41 is identical with that in the embodiment of FIGS. 1 through 4. Each of the resilient tongues 42,43 is just an extension of the main portion 47 extending marginally from an upper end thereof, and terminates in a curved end 48,49. The curved end 48,49 of each resilient tongue 42,43 is supported on its concave side by a rounded top 50,51 of respective one of the projections 44,45 and on its convex side by the ceiling 34 (FIGS. 3 and 4) of the yoke 16. A first retaining portion 52 of the spring 41 extends centrally from an upper end of the main portion 47, sloping down toward the upper wing 46, then extends parallelly of the latter passing between the two projections 44,45, and terminates in a downwardly bent end 53 received in the minor-width groove 31 of the neck 14. This modified slider 40 operates in the same manner as that in the embodiment of FIGS. 1 through 4.

Figure 7:
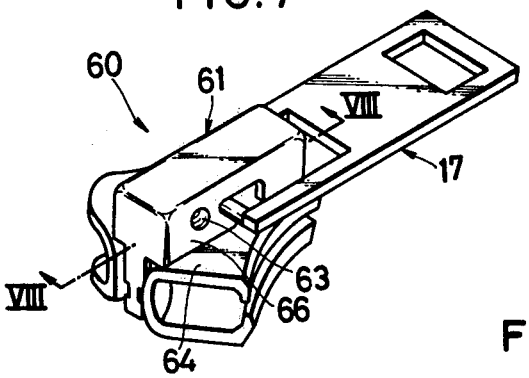
FIG. 7 is a perspective view of another modified form of slider according to the invention.
Figure 8:
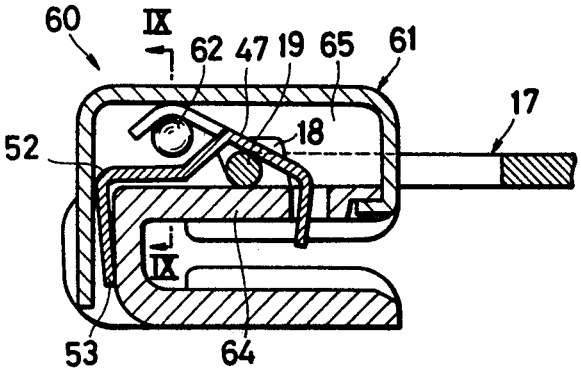
FIG. 8 is an enlarged cross-sectional view taken along the line VIII—VIII of FIG. 7.
Figure 9:
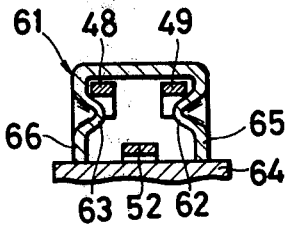
FIG. 9 is a cross-sectional view taken along the line IX—IX of FIG. 8.
Figure 10:
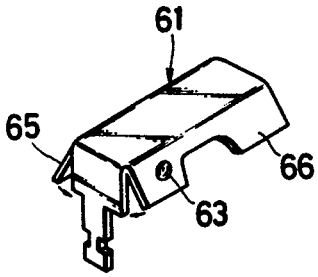
FIG. 10 is a perspective view of a yoke shown in FIG. 7, with its opposite side walls remained slightly opened.

FIGS. 7 and 8 show another modified slider 60, in which the only difference from the embodiment of FIGS. 5 and 6 is that a modified yoke 61 has a pair of opposed projections 62,63 for supporting the respective resilient tongues 42,43 of the spring 41, there being no projections for the same purpose on an upper slider body wing 64. The projections 62,63 extend from respective inner surfaces of opposite side walls 65,66 of the yoke 61 toward and terminating far short of each other. Each of the projections 62,63 has a generally cone-shape. For assembly, after the pull tab 17 and the locking spring 41 are mounted on the upper wing 64, the yoke 61 is secured to the latter in the manner as aforementioned, with the opposite side walls 65,66 retained slightly opened (FIG. 10). Then, these two side walls are forced toward each other till they are disposed in their operating position shown in FIG. 9. This modified slider 60 operates in the same manner as those in the preceding embodiments.

With the structural features set forth above, throughout the various embodiments, the locking prong is prevented from accidentally shifting out of engagement with two successive fastener elements of a slide fastener. Further, the locking spring is protected against undergoing transverse displacement.

A few specific illustrative embodiments of the invention have been described. It will, of course, be appreciated however that the invention is not limited to these specific embodiments since numerous changes and modifications may be made therein as will appear obvious to one versed in the art without departing the scope of the appended claims.

What is claimed is:

1. An automatically locking slider for a slider fastener, comprising in combination:

(a) a body including first and second wings connected at one end by a neck so as to define therebetween a generally Y-shaped guide channel;

(b) a yoke attached to said first wing;

(c) a locking spring supported on said body and concealed by said yoke, said locking spring having a locking prong movable into and out of said guide channel, a first retaining portion resting on said body, and a second retaining portion;

(d) pivot means supporting said second retaining portion in a plane above and remote from the general plane of said first wing so as to permit said locking prong to move angularly about said pivot means, said pivot means including a pair of opposed projections on respective inner surfaces of opposite side walls of said yoke; and (e) a pull tab connected to said locking spring for retracting said locking prong away from said guide channel against the bias of said locking spring.

2. A slider according to claim 1, wherein said pivot means is carried by said yoke.

3. An automatically locking slider for a slide fastener, comprising in combination:

(a) a body including first and second wings connected at one end by a neck so as to define therebetween a generally Y-shaped guide channel;

(b) a yoke attached to said first wing;

(c) a locking spring supported on said body and concealed by said yoke, said locking spring having a locking prong movable into and out of said guide channel, a first retaining portion resting on said body, and a second retaining portion including at least one resilient tongue having a curved end;

(d) pivot means having said at least one resilient tongue curved end extending thereabout for supporting said second retaining portion in a plane above and remote from the general plane of said first wing so as to permit said locking prong to move angularly about said pivot means; and (e) a pull tab connected to said locking spring for retracting said locking prong away from said guide channel against the bias of said locking spring.

4. A slider according to claim 3, wherein said pivot means is carried by said first wing.

5. A slider according to claim 3, wherein said pivot means includes a projection extending from said first wing toward and terminating short of a ceiling of said yoke.

6. A slider according to claim 1 or 3, wherein said pivot means has a rounded portion.

* * * * *